US007748398B2

(12) United States Patent
Miller

(10) Patent No.: US 7,748,398 B2
(45) Date of Patent: Jul. 6, 2010

(54) PRESSURE RELIEF VALVE FOR A CONTAINER

(75) Inventor: Daniel Miller, Milford, OH (US)

(73) Assignee: Buckhorn, Inc., Milford, OH (US)

( * ) Notice: Subject to any disclaimer, the term of this patent is extended or adjusted under 35 U.S.C. 154(b) by 419 days.

(21) Appl. No.: 11/979,661

(22) Filed: Nov. 7, 2007

(65) Prior Publication Data

US 2009/0114291 A1 May 7, 2009

(51) Int. Cl.
*F16K 17/40* (2006.01)

(52) U.S. Cl. ..... 137/68.29; 220/89.3

(58) Field of Classification Search ..... 137/68.29, 137/68.3; 220/89.3
See application file for complete search history.

(56) References Cited

U.S. PATENT DOCUMENTS 2,225,220 A * 12/1940 Huff ..... 220/89.3
2,291,360 A * 7/1942 Unger ..... 220/89.3
2,707,398 A * 5/1955 Waite ..... 137/68.29
3,391,951 A * 7/1968 Miller ..... 137/68.29
3,834,580 A * 9/1974 Ludwig et al. ..... 137/68.29
3,872,874 A * 3/1975 Nedelec et al. ..... 137/68.29
3,906,976 A * 9/1975 Nohr et al. ..... 137/68.29
5,337,775 A * 8/1994 Lane et al. ..... 137/68.29

* cited by examiner

*Primary Examiner*—John Rivell
(74) *Attorney, Agent, or Firm*—Mattingly & Malur, P.C.

(57) ABSTRACT

A pressure relief valve for a container having a liner therein for holding food products includes a hollow body incorporated into a lid of the container and extends inwardly therefrom. A cutter member is mounted in an opening at an outer end of the body and has a knife extending inwardly through the valve body. A piston is slidably connected to the body and has an opening therein for receiving the knife and a compression spring is mounted around the knife and positioned between a top of the cutter and a bottom of the piston to bias the piston inwardly away from the wall. Pressure buildup in the liner causes the liner to expand and push the piston outwardly towards the lid to expose the knife which then punctures the liner and relieves the pressure therein and allows a product to be discharged from the container through the valve.

15 Claims, 7 Drawing Sheets

PRESSURE RELIEF VALVE FOR A CONTAINER

BACKGROUND OF THE INVENTION

1. Field of the Invention

The present invention relates to a pressure relief valve for a container and more particularly to a pressure relief valve for a container having a liner therein whereby when pressure builds up in the liner, the pressure relief valve automatically operates to puncture the liner and relieve the pressure therein.

2. Description of the Related Art

Containers of various types and sizes are known in the art which have a wide variety of uses, such as for storing and transporting food products. Collapsible or knock down containers are known which are made entirely or substantially entirely from plastic materials using a molding technique known as injection molding. Such containers have a pallet type base with sidewalls and endwalls pivoted to the base and adapted to move from a folded position on the pallet to an erect position for holding goods. Many of such containers have a lid for closing the top thereof. Such containers are commonly used in the storage and transportation of fluids, such as tomato paste or other food products which are perishable. The products are often contained in a liner or bag within the container. On occasion, products such as tomato paste become contaminated with bacteria resulting in a dangerous pressure buildup within the liner. When the pressure buildup becomes extreme, the liner expands and explodes and splits containers open and the contents spewed out. When this happens, it is possible to cause injury to workers, particularly when a plurality of such containers are stacked and a number of the containers on the stack explode, causing a stack failure.

Thus, a need exists for a means for relieving pressure buildup in a container having a liner therein filled with food products such as tomato paste so that the containers are not split open.

SUMMARY OF THE INVENTION

It is an object of the present invention to provide a pressure relief valve for a container having a liner therein which is filled with products which may cause a pressure buildup within the liner.

It is another object of the invention to provide a pressure relief valve for a container having a liner therein filled with products which automatically operate to puncture the liner when pressure buildup occurs therein.

It is still another object of the invention to provide a pressure relief valve for a container having a liner therein filled with perishable food products such as tomato paste wherein when contamination of the food product occurs and pressure builds up within the liner, the pressure relief valve automatically operates to puncture the liner, relieve the pressure therein and allow the pace product to expand out through the pressure relief valve to the outside of the container.

It is further object of the invention to provide the pressure relief valve for a container having a liner therein wherein the pressure relief valve is incorporated into the lid of the container.

The present invention achieves the above and other objects by providing a pressure relief valve for a container having a liner therein for holding food products such as tomato paste wherein the valve includes a hollow body incorporated in a wall such as a lid of the container and extends inwardly therefrom. A cutter member is mounted in an opening at an outer end of the body and has a knife extending inwardly through the valve body. A piston is slidably connected to the body and has an opening therein for receiving the knife and a compression spring is mounted around the knife and positioned between a top of the cutter and a bottom of a piston to bias the piston inwardly away from the wall. When pressure builds up in the liner, such as pressure caused by contamination of a food product such as tomato paste, the liner expands and pushes the piston outwardly towards the wall or lid to expose the knife which then punctures the liner and relieves the pressure therein and allows the food product to be discharged from the container through the valve.

The cutter member includes an outer circular plate having the knife extending inwardly therefrom. The lid or wall has a circular recess surrounding the opening of the body and the circular plate is rotatably mounted in the circular recess for rotation between a transport position wherein the piston is locked against outward movement on the body and a storage position where the piston is free to move outwardly on the valve body. The cutter member also includes an opening extending lengthwise from an inner end of the knife through a top of the cutter member whereby the contents of the liner expand through the opening to outside of the container when the liner is punctured.

These and other features and advantages of the present invention will become more apparent with reference to the following detailed description and the drawings.

DETAILED DESCRIPTION OF THE PREFERRED EMBODIMENTS

Figure 1:
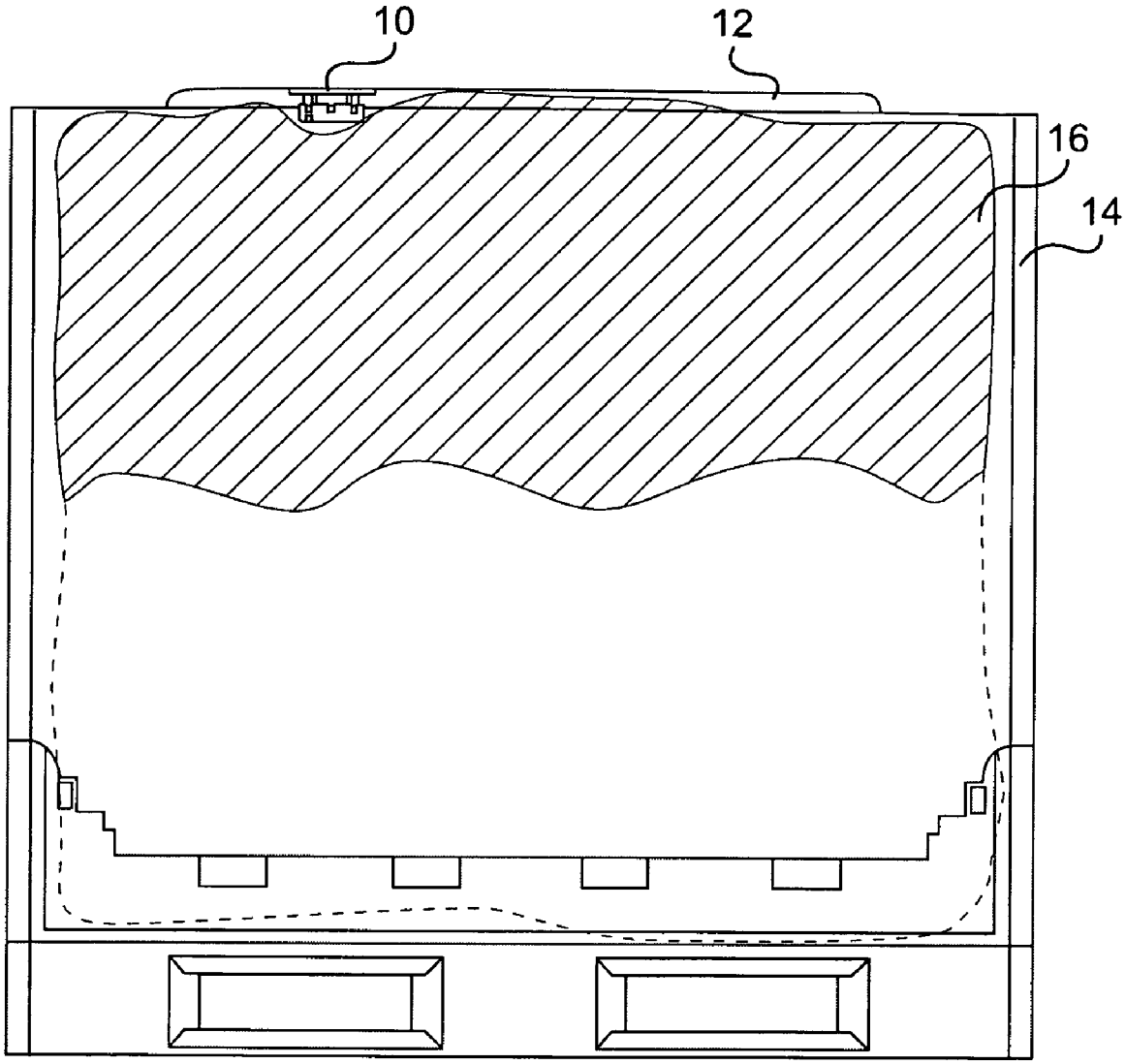
FIG. 1 is a side elevational view, partially broken away, of a container with a liner therein and having a pressure relief valve of the present invention incorporated in the container lid.

Shown in FIG. 1 is a front view of a container 14 having a liner or bag 16 positioned therein and having a pressure relief valve 10 incorporated into the top wall or lid 12. The container may be constructed of plastic parts that are made by injection molding using a synthetic resin molding technique that includes molding the base or bottom, sidewalls, end walls and lid or top wall of a synthetic resin material. A suitable plastic container is described in my pending application Ser. No. 11/028,578 filed Jan. 5, 2005 and which is incorporated herein by reference. The container is particularly well suited for containing a material such as tomato paste by putting the liner 16 into the container and filling the liner with tomato paste.

The pressure relief valve 10 is made of plastic and is of a construction such that the body of the valve may be molded right into the lid 12 or other wall in which it is mounted. While the pressure relief valve may be mounted in one of the sidewalls, when the container is a collapsible container, it is incorporated into the lid 12 so that it does not interfere with the folding of the sidewalls when the container is collapsed.

As shown in greater detail in FIGS. 2-7, the pressure relief valve 10 of the present invention includes a hollow cylindrical body 20 incorporated into the lid 12 of the container by being molded integrally therewith. The body 20 extends inwardly from the lid towards the inside of the container. The valve body 20 has a plurality of spaced slots 22 extending from the inner end of the body outwardly to the bottom of the lid 12. The slots define a plurality of body segments 24 each having a radially extending lip 26 at the inner end thereof.

Figure 3:
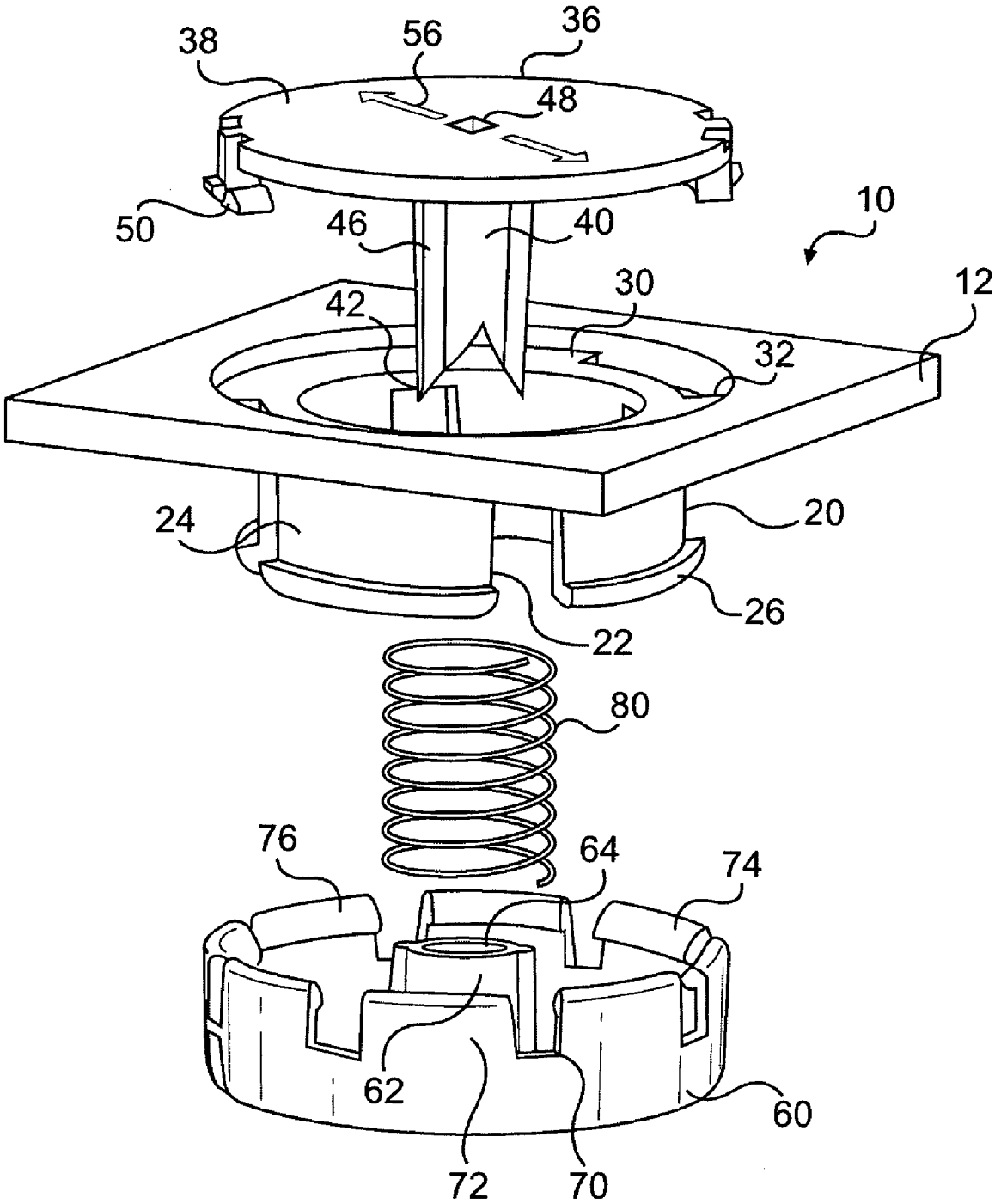
FIG. 3 is an exploded view of the pressure relief valve showing the various parts thereof.

As shown in FIG. 3, the lid 12 is provided with a recess 30 around the top of the body 20. The recess 30 further is provided with two slots 32 at its outer edge. Catches 34 are provided on the inside of the lid at the edges of the slots 32.

Figure 4A:
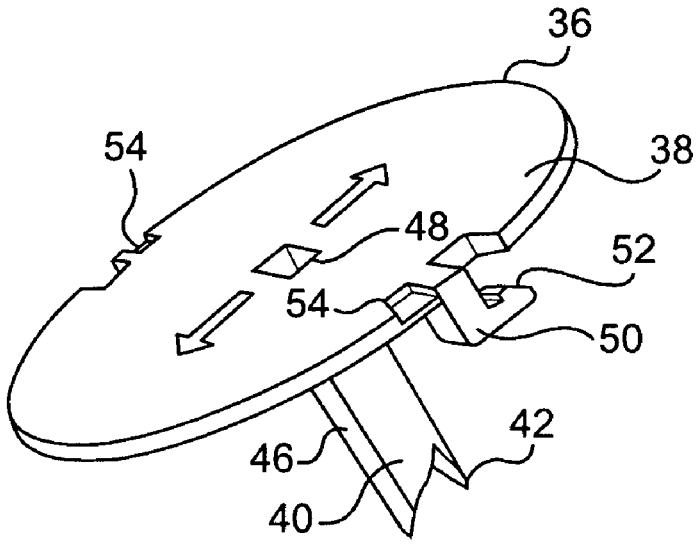
FIG. 4A is a top perspective view of the cutter member of the pressure relief valve.
Figure 4B:
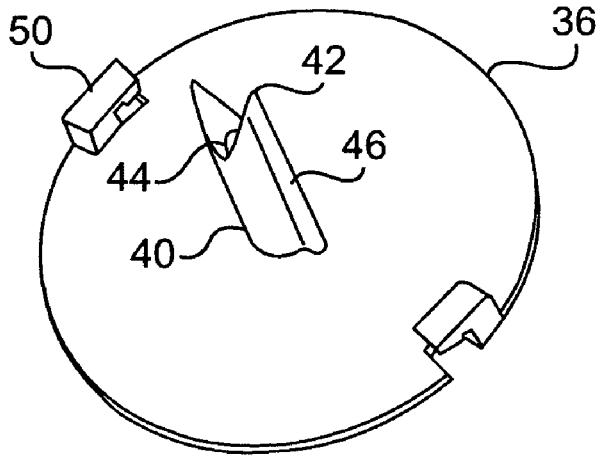
FIG. 4B is a bottom perspective view of the cutter member of the pressure relief valve.

The pressure relief valve further includes a cutter member 36 mounted at an outer end of the body and rotatable in recess 30. A knife member 40 extends inwardly from the bottom of a circular plate 38 and extends through the hollow interior of the valve body 20. As shown in FIGS. 3, 4A and 4B, the knife 40 has a pair of sharpened points or edges 42 at the inner end thereof and a center hole 44 extending from the inner end thereof out through the top of the circular plate 38. The center hole 44 may be rectangularly shaped on its outside end to receive a tool for rotating the plate. The knife 40 also is provided with a pair of ribs 46 on the sides thereof.

Figure 7:
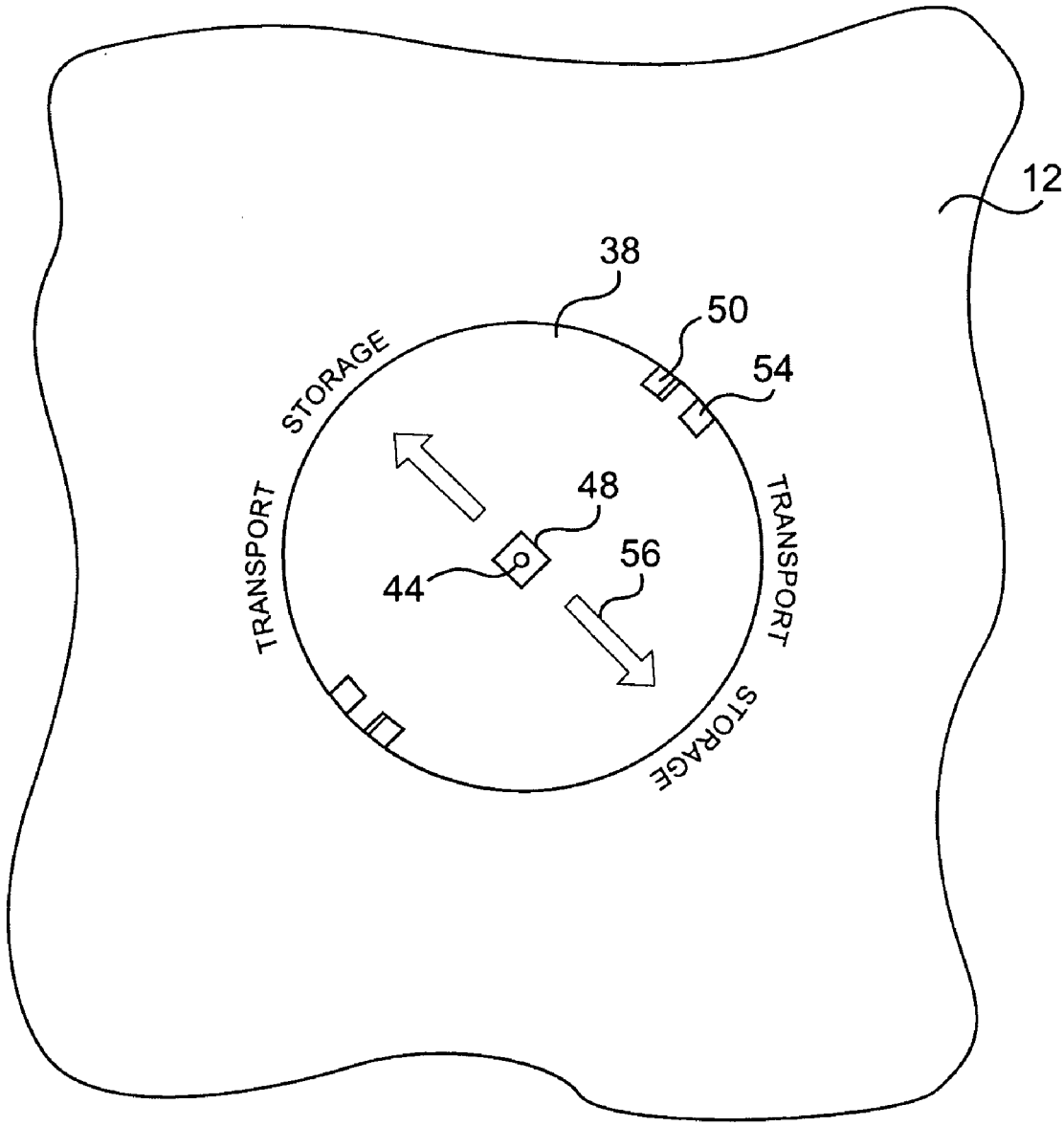
FIG. 7 is a top plan view of the pressure relief valve illustrating the storage and transport positions of the valve.

The circular plate 38 is also provided with an inwardly extending locking tab 50 having a detent 52 at an end thereof on each side of the plate as shown in FIGS. 4A and 4B. The detents 52 engage the catches 34 where the circular plate is mounted in the valve body. A notch 54 is provided in the top of the circular plate next to each locking tab 50 so that a tool may be inserted into the notches to turn the plate. As shown in FIG. 7 arrows 56 are provided on the outer surface of the circular plate 38 to indicate whether the cutter member is in a storage position or a transport position.

Figure 2:
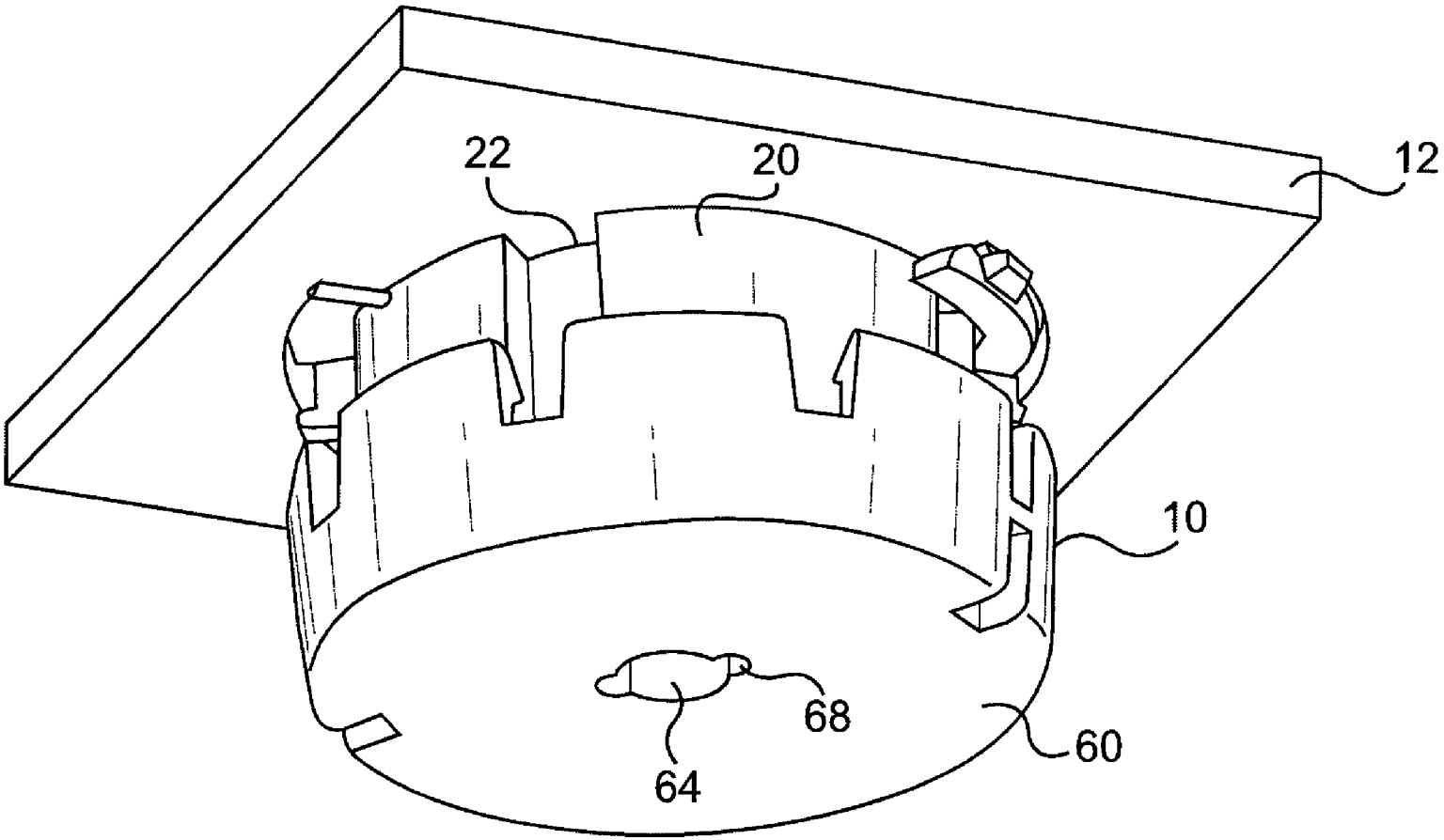
FIG. 2 is a bottom perspective view of the pressure relief valve of the present invention showing the piston extended in a storage position.
Figure 5:
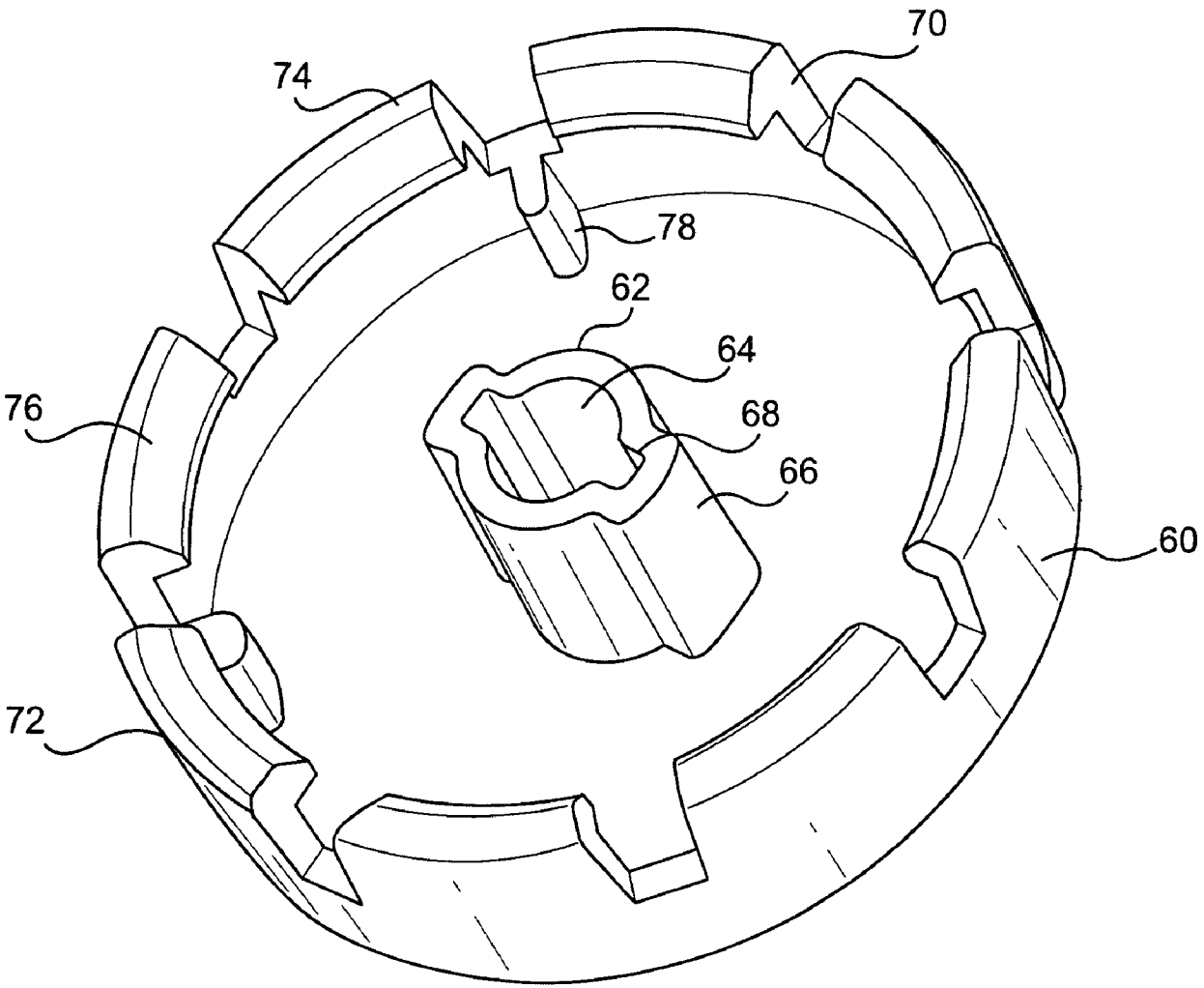
FIG. 5 is a top perspective view of the piston of the pressure relief valve.
Figure 6:
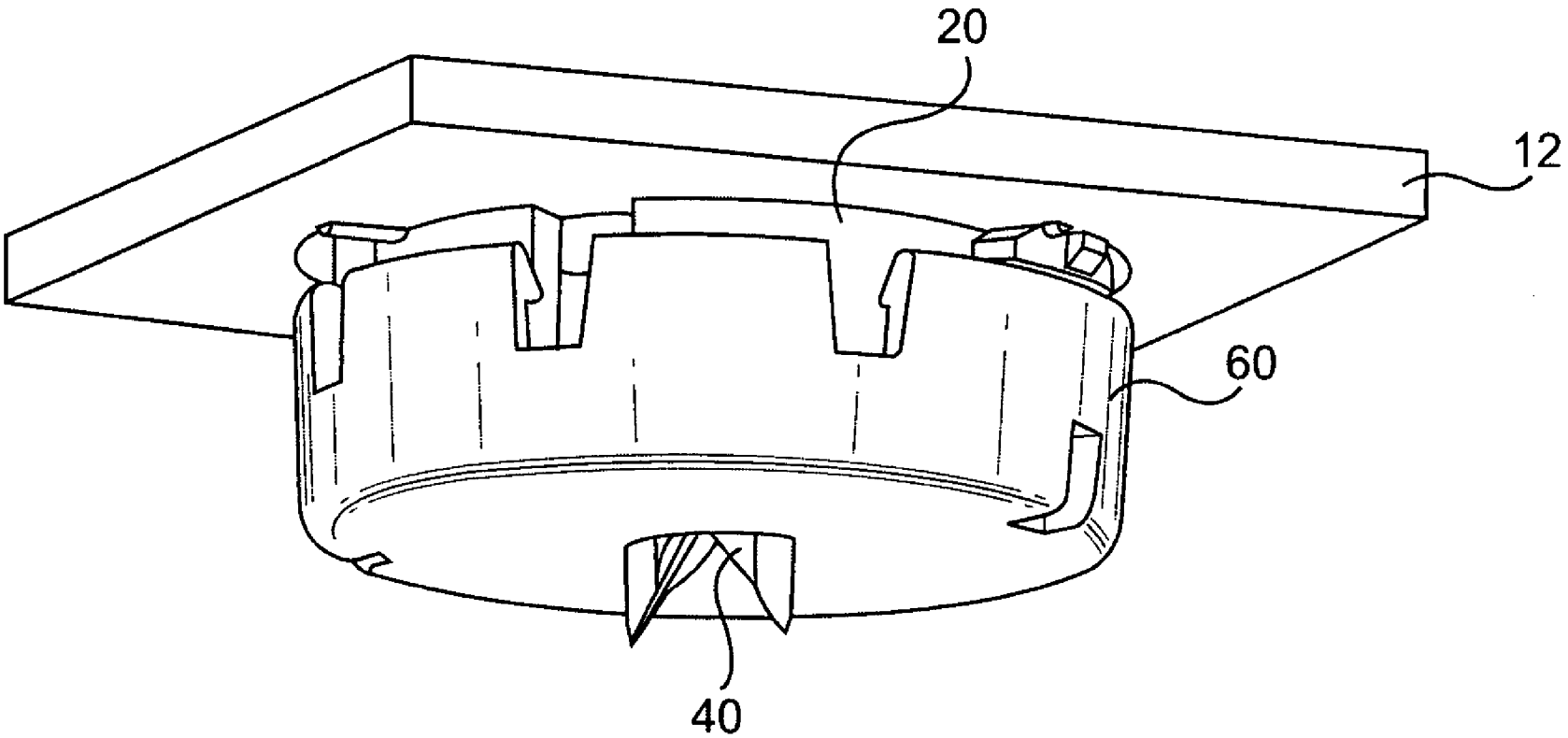
FIG. 6 is a bottom perspective of the pressure relief valve showing the piston pushed back to expose the knife in an active position.

The pressure relief valve 10 further includes a piston 60 slidably connected to the valve body 20 and having a central hub 62 extending upwardly from the inside thereof and which has a hole 64 extending therethrough to receive the knife 40 therein. As shown in FIG. 5, each side of the hub 62 is provided with a rib 66 having a slot or keyway 68 therein to receive the ribs 46 on the sides of the knife 40 so that the piston is caused to rotate when the cutter member 36 is rotated. The outer wall of the piston 60 is provided with a plurality of slots 70 which divide the wall of the piston into segments 72. The inner end of each segment 72 is provided with a lip 74 which extends radially inwardly as shown in FIG. 3. The inner face 76 of each lip 74 is sloped from the inside towards the outside so that the lip may be cammed over lip 26 on each body segment 26 when the piston is mounted to the body. When the piston is in the storage position as shown in FIG. 2, the piston is retained in its innermost extended position by lips 74 which lock with lips 26 on the valve body.

The piston 60 is also provided with ribs 72 on the inside thereof as shown in FIG. 5 which are adapted to slide through slots 22 on the valve body when the piston is moved all the way outwardly to a storage position.

As shown in FIG. 3, a compression spring 80 is mounted around the hub 62 of the piston and the knife 40 extends therethrough when the valve is assembled. The spring is held between the inside of the circular plate 36 and the bottom of the piston 60 to bias the piston inwardly away from the lid or wall 12.

When the pressure relief valve is incorporated into the lid of a container, the valve body is molded integrally with the lid and extends inwardly into the container. The circular plate is then inserted into the recess 30, the spring is mounted around the hub 62 of the piston and the piston is then pushed onto the inner end of the body 20 whereupon the lips 74 of the piston are cammed over the lips 26 on the inner end of the body so that the piston is locked onto the body for slidable movement thereon.

When the liner of the container is filled with a product such as a tomato paste and stored, the cutter member 36 is rotated to the storage position wherein the piston is biased by the spring to extend inwardly so that the knife is totally contained within the valve and does not extend outside thereof. When in the storage position, the valve is free to slide outwardly on the piston body to expose the knife edges 42.

If a pressure buildup occurs in the liner such as that which occurs when the paste in the liner becomes contaminated, the liner expands and pushes against the inner end of the piston to force the piston upwardly and expose the knife edges outside of the body. When the knife edges contact the liner, the liner is punctured and the contents of the liner expand outwardly through the hole 44 in the knife and spill out over the lid of the container to indicate that the paste is contaminated and therefore should not be shipped.

If, however, when the container is to be shipped, no paste appears on the outside of the lid, the circular plate may be rotated by a tool to the transport position wherein the piston is locked against moving outwardly by the ribs 66 which contact the bottoms of the lips 26 of the valve body.

Numerous other modifications and adaptations of the present invention will be apparent to those skilled in the art and thus, it is intended by the following claims to cover all such modifications and adaptations which fall within the true spirit and scope of the invention.

I claim:

1. A pressure relief valve for use with a container having a liner for holding products therein, said valve comprising:

a) a hollow body incorporated in a wall of said container and extending inwardly therefrom;

b) a cutter member mounted at an outer end of said body and having a knife extending inwardly through said body;

c) a piston slidably connected to said body and having an opening therein for receiving said knife; and d) a compression spring mounted around said knife and positioned between a top of said cutter member and a bottom of said piston to bias said piston inwardly away from said wall, e) whereby when pressure builds up in said liner, the liner expands and pushes the piston outwardly towards said wall to expose the knife which punctures the liner and relieves the pressure therein.

2. A pressure relief valve according to claim 1 wherein said body is incorporated into a lid of said container.

3. A pressure relief valve according to claim 1 wherein said cutter member includes an outer circular plate having said knife extending inwardly therefrom, said wall has a circular recess surrounding said opening of said body and said circular plate is rotatably mounted in said circular recess for rotation between a transport position wherein said piston is locked against outward movement on said body and a storage position wherein said piston is free to move outwardly on said body.

4. A pressure relief valve according to claim 1 wherein said cutter member includes an opening extending lengthwise from an inner end of said knife through a top of said cutter member whereby contents of said liner expand through said opening to outside of said container when said liner is punctured.

5. A pressure relief valve according to claim 1 wherein said piston includes a central hub extending outwardly from the bottom thereof through which said knife extends.

6. A pressure valve according to claim 5 wherein one of said knife and said hub includes a rib and the other of said knife and said hub includes a slot whereby said rib engages said slot so that rotation of said cutter member causes said piston to rotate.

7. A pressure relief valve according to claim 3 wherein said plate has a locking tab on its inner side which extends through a slot in said recess to engage a catch to lock said cutter member against rotation.

8. A pressure relief valve according to claim 3 wherein an inner end of said body is provided with a lip which engages a lip on an outer end of said piston when said piston is in said storage position.

9. A pressure relief valve according to claim 3 wherein an inside of said piston is provided with a rib which engages a slot in said body when said piston is in said transport position.

10. A pressure relief valve for use with a container having a liner for holding products therein, said valve comprising:

a) a hollow body incorporated in a lid of said container and extending inwardly therefrom;

b) a recess in said lid surrounding said body;

c) a cutter member mounted at an outer end of said body and having a knife extending inwardly through said body, said cutter member including an outer circular plate from which said knife extends inwardly and said circular plate is rotatably mounted in said circular recess for rotation between a transport position wherein said piston is locked against outward movement on said body and a storage position wherein said piston is free to move outwardly on said body;

d) an opening extending lengthwise from an inner end of said knife through a top of said cutter member;

e) a piston slidably connected to said body and having an opening therein for receiving said knife and;

f) a compression spring mounted around said knife and positioned between a top of said cutter member and a bottom of said piston to bias said piston inwardly away from said wall, g) whereby when pressure builds up in said liner, the liner expands and pushes the piston outwardly towards said wall to expose the knife which punctures the liner and relieves the pressure therein and whereby the contents of said liner may expand through said opening to outside of said container.

11. A pressure relief valve according to claim 10 wherein said piston includes a central hub extending outwardly from the bottom thereof through which said knife extends.

12. A pressure valve according to claim 11, wherein one of said knife and said hub includes a rib and the other of said knife and said hub includes a slot whereby said rib engages said slot so that rotation of said cutter member causes said piston to rotate.

13. A pressure relief valve according to claim 10, wherein said plate has a locking tab on its inner side which extends through a slot in said recess to engage a catch to lock said cutter member against rotation.

14. A pressure relief valve according to claim 10 wherein an inner end of said body is provided with a lip which engages a lip on an outer end of said piston when said piston is in said storage position.

15. A pressure relief valve according to claim 10 wherein an inside of said piston is provided with a rib which engages a slot in said body when said piston is in said transport position.

* * * * *